US005941149A

United States Patent [19]

Röhe

[11] Patent Number: 5,941,149

[45] Date of Patent: Aug. 24, 1999

[54] HOLDDOWN BAR FOR TEXTILE-CENTERING AND -CUTTING MACHINE

[75] Inventor: Peter Röhe, Ochtrup, Germany

[73] Assignee: Schmale-Holding GmbH & Co., Ochtrup, Germany

[21] Appl. No.: 08/953,024

[22] Filed: Oct. 17, 1997

[30] Foreign Application Priority Data

Dec. 14, 1996 [DE] Germany ..... 296 21 736 U

[51] Int. Cl.[6] ..... B26D 7/14

[52] U.S. Cl. ..... 83/175; 83/452; 83/461; 83/460; 83/459; 269/224; 269/266

[58] Field of Search ..... 83/452, 459, 460, 83/461, 175, 465, 466; 269/266, 224; 26/74, 87

[56] References Cited

U.S. PATENT DOCUMENTS

| | | | |
|---|---|---|---|
| 980,241 | 1/1911 | Gardner et al. | 269/224 |
| 1,881,185 | 10/1932 | Hazelton | 269/224 |
| 1,898,565 | 2/1933 | Munschauer | 269/224 |
| 2,311,147 | 2/1943 | Williamson | 83/461 |
| 2,314,645 | 3/1943 | Duda | 269/224 |
| 2,323,770 | 7/1943 | Hazelton | 269/266 |
| 3,034,389 | 5/1962 | Pater | 83/466 |
| 3,046,823 | 7/1962 | Cole | 83/175 |
| 3,273,437 | 9/1966 | Scott | 83/465 |
| 3,353,818 | 11/1967 | Hill | 83/465 |
| 4,034,634 | 7/1977 | Arbter | 83/175 |
| 4,187,751 | 2/1980 | Barnacle | 83/458 |
| 4,586,411 | 5/1986 | Koivula | 83/175 |
| 4,609,182 | 9/1986 | Freermann | 83/175 |
| 4,926,725 | 5/1990 | Halgesson | 83/175 |
| 4,949,609 | 8/1990 | Sohtome et al. | 83/175 |
| 5,152,707 | 10/1992 | Dougherty et al. | 269/266 |

FOREIGN PATENT DOCUMENTS

| | | | |
|---|---|---|---|
| 2839236 | 3/1979 | Germany | 83/465 |
| 3431210 C2 | 4/1985 | Germany . | |

*Primary Examiner*—M. Rachuba
*Assistant Examiner*—Stephen Choi
*Attorney, Agent, or Firm*—Herbert Dubno; Andrew Wilford

[57] ABSTRACT

A holddown bar assembly for a textile-centering and cutting machine through which a web is advanced in a direction has a lower bar underneath the goods and extending transversely of the direction a full width of the web and an upper support bar above the goods, extending the full width of the web, and provided with a vertical guide. A row extending the full width of the web of finger plates are vertically displaceable relative to each other on the guide directly above the lower bar so that the web can be pinched between the row of finger plates and the lower bar. A biasing unit is engaged between the upper support bar and the finger plates for urging the finger plates downward against the web.

4 Claims, 1 Drawing Sheet

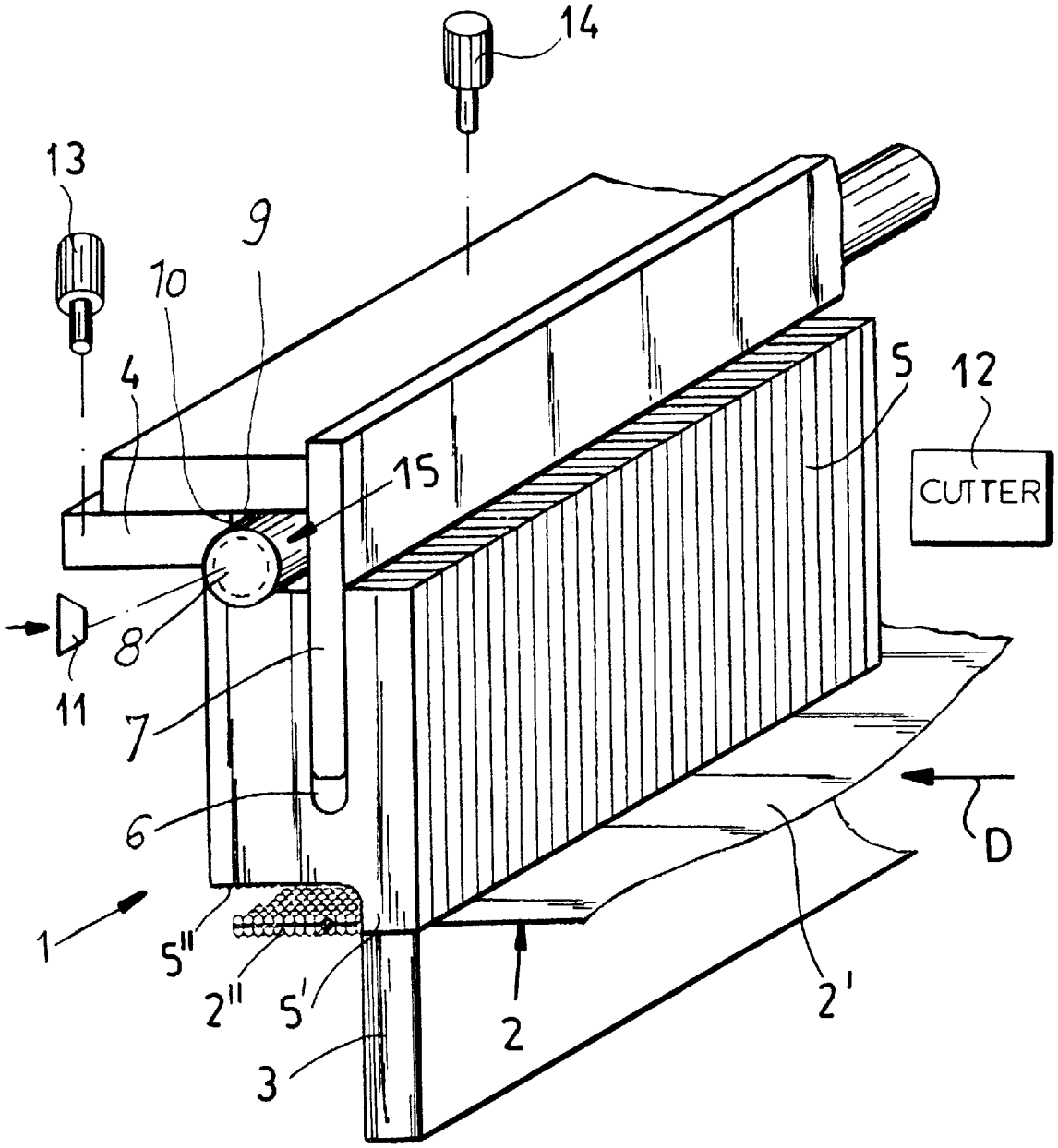
14
13
9
10
4
5
12
CUTTER
15
8
11
7
6
D
1
5''
2''
5'
2
2'
3

HOLDDOWN BAR FOR TEXTILE-CENTERING AND -CUTTING MACHINE

FIELD OF THE INVENTION

The present invention relates to a holddown bar. More particularly this invention concerns such a bar used in a machine that centers and cuts textile goods.

BACKGROUND OF THE INVENTION

A standard towel-making machine advances a continuous web of textile goods having relatively long and thick pile zones separated by short transversely throughgoing and relatively thin pile-free zones or strips. The goods are advanced in steps and at each step a section is transversely cut from the leading end, with the cut in the middle of the pile-free strip.

To correctly position the goods in the cutter a device such as described in German patent 3,431,210 (U.S. equivalent patent 4,609,182) is used. It has a pair of holder assemblies each comprising an upper and a lower holddown bar that flank the cutter in the transport direction of the goods and that can be brought into contact with the goods to clamp them and spread them under the cutter, centering the pile-free strip under the cutter. Due to the moderate elasticity of the goods being cut it is impossible to ensure that the pile-free strip will be perfectly centered under the cutter when the means that advances the goods stops each time. Thus the holders are closely juxtaposed with the cutter to start with. As soon as the goods stop, both upper bars are lowered to pinch the pile-free zone against the lower bar and then the holders are moved out-ward, sliding on the goods in the pile-free zone until they encounter the edge of the pile zone, whereupon they can no longer slip so that they stretch the pile-free zone tight between the two holders, perfectly centered under the cutter. The blade then drops or travels transversely across the thus centered zone to make the cut.

Since the goods frequently have relatively thick longitudinal seams, it is necessary that one of the bars of each holder, normally the upper bar, be constructed to accommodate the welt formed by the seam. A rigid bar would not work as the thickened seam would hold it up so that it would not slide to and engage on the edge of the pile zone. Thus each upper bar is formed by a row of finger plates that are limitedly vertically displaceable relative to a rigid mounting bar that itself is displaceable vertically to bring the finger plates into and out of contact with the goods and longitudinally, that is parallel to the workpiece travel direction, to stretch out the pile-free zone and center it under the cutter.

While such a system is relatively effective, it does not work well with all times of fabric. The upper holder bar can jump over the edge of the pile free zone on thinner looped goods.

OBJECTS OF THE INVENTION

It is therefore an object of the present invention to provide an improved holddown bar for a textile-centering and -cutting machine.

Another object is the provision of such an improved holddown bar for a textile-centering and -cutting machine which overcomes the above-given disadvantages, that is which surely positions the finger plates on the goods for accurate stretching without skipping over the edge of even thin pile goods.

SUMMARY OF THE INVENTION

A holddown bar assembly for a textile-centering and cutting machine through which a web is advanced in a direction has a lower bar underneath the goods and extending transversely of the direction a full width of the web and an upper support bar above the goods, extending the full width of the web, and provided with a vertical guide. A row extending the full width of the web of finger plates are vertically displaceable relative to each other on the guide directly above the lower bar so that the web can be pinched between the row of finger plates and the lower bar. According to the invention a biasing unit is engaged between the upper support bar and the finger plates for urging the finger plates downward against the web.

The biasing unit includes a flexible closed-end tube extending the full width of the web and bearing upward on the support bar and downward on the fingers and means for internally pressuring the tube with a fluid.

Thus it is possible according to the invention to press the holddown fingers against the web with a force particularly tailored to the particular goods being centered and cut. When the pile is relatively deep and the goods are fairly soft, a low pressure is used while when the pile-free zone is relatively thin a higher pressure can be employed. Normally the tube is pressurized with air so that the same pressure is applied to each and every finger plate.

The tube in accordance with the invention is above the finger plates. Furthermore the support bar forms a downwardly open groove extending the full width of the web and receiving the tube.

BRIEF DESCRIPTION OF THE DRAWING

The above and other objects, features, and advantages will become more readily apparent from the following description, reference being made to the accompanying drawing whose sole FIGURE is a partly diagrammatic and perspective view of the system of this invention.

SPECIFIC DESCRIPTION

As seen in the drawing a holddown bar assembly 1 for pile-type textile goods 2 is positioned adjacent a schematically represented cutter 12. The goods 2 are moved in a transport direction D and have a pile-free strip 2' and a pile zone 2". Although only one such bar assembly 1 is shown, normally such assemblies are used in pairs, flanking the cutter 12 in the direction D as described in the above-cited German patent and are limitedly movable in this direction by an actuator shown schematically at 13.

According to the invention the bar assembly 1 comprises a one-piece lower bar 3 and an upper support bar 4 carrying a plurality of vertically displaceable steel finger plates 5. The plates 5 are aligned in direct contact with one another and each have a small downwardly projecting finger 5' measuring some 4 mm wide (in the direction D), 2 mm thick, and 5 mm high. Each plate 5 is formed with a vertically extending slot 6 in which engages a vertically extending guide plate 7 fixed to the holder bar 4 so that these plates 5 can move freely vertically through a stroke substantially higher than the tallest pile likely to be encountered.

The bar 4 is formed with a notch 15 having an upper surface 9 directed downwardly at upwardly directed upper surfaces of the plates 5 and a horizontally directed back surface 10 axially confronting a rear face of the plate 7 to form the downwardly open notch or groove 15 extending a full length of the bar 4. An elastic closed-end tube 8 is provided in this groove 15 and is connected to a compressor 11 or other inflating means.

Thus in accordance with the invention once the bar 4 has been dropped by means such as a schematically illustrated actuator 14 down onto the pile-free strip 2', the tube 8 can be inflated to press the plates 5 solidly down against this strip 2'. Thus they will engage it with substantially more force than that of gravity effective on their mass, but at the same time they will be able to fit around a seam or other bump in the goods without difficulty.

I claim:

1. A holddown bar assembly for a textile-centering and cutting machine through which a web is advanced in a direction, the holddown bar assembly comprising:

a lower bar underneath the web and extending transversely of the direction a full width of the web;

an upper support bar above the web, extending the full width of the web, and provided with a vertical guide;

a row extending the full width of the web of finger plates vertically displaceable relative to each other on the guide directly above the lower bar, whereby the web can be pinched between the row of finger plates and the lower bar; and biasing means including an elastically deformable closed-end tube extending the full width of the web and bearing upward on the upper support bar and downward on the finger plates and means connected to the tube for internally pressurizing the tube with a fluid for urging the finger plates downward against the web.

2. The holddown bar assembly defined in claim 1 wherein the tube is above the finger plates.

3. The holddown bar assembly defined in claim 1 wherein the upper support bar forms a downwardly open groove extending the full width of the web and receiving the tube.

4. The holddown bar assembly defined in claim 1 wherein the finger plates are flat and lie in direct contact with one another in the row.

* * * * *